US006771030B2

(12) United States Patent
Sano

(10) Patent No.: US 6,771,030 B2
(45) Date of Patent: Aug. 3, 2004

(54) COLOR CATHODE RAY TUBE APPARATUS

(75) Inventor: Yuichi Sano, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 86 days.

(21) Appl. No.: 10/305,320

(22) Filed: Nov. 27, 2002

(65) Prior Publication Data

US 2003/0076058 A1 Apr. 24, 2003

Related U.S. Application Data

(63) Continuation of application No. PCT/JP02/02468, filed on Mar. 15, 2002.

(30) Foreign Application Priority Data

Mar. 27, 2001 (JP) ..... 2001-091095

(51) Int. Cl.[7] ..... G09G 1/04; H01J 29/70
(52) U.S. Cl. ..... 315/364; 315/399; 313/440
(58) Field of Search ..... 315/364, 399; 313/440, 413, 437, 442

(56) References Cited

U.S. PATENT DOCUMENTS 4,229,720 A 10/1980 Heijnemans et al. ..... 335/213
4,939,415 A * 7/1990 Iwasaki et al. ..... 313/440
5,001,390 A * 3/1991 Vink et al. ..... 313/440
5,783,901 A * 7/1998 Shimada et al. ..... 313/440
6,166,484 A * 12/2000 Okuyama et al. ..... 313/440
6,307,314 B1 * 10/2001 Sano ..... 313/440

FOREIGN PATENT DOCUMENTS

EP 0 689 223 A1 6/1994
EP 1 081 738 A1 3/2001

* cited by examiner

*Primary Examiner*—Wilson Lee
*Assistant Examiner*—Chuc Tran
(74) *Attorney, Agent, or Firm*—Pillsbury Winthrop LLP

(57) ABSTRACT

A cathode ray tube apparatus comprises the deflection yoke including a horizontal deflecting coil for deflecting the electron beams in a horizontal direction. The horizontal deflecting coil has a main coil portion located along the direction of a tube axis, a flange portion located on the phosphor-screen side of the main coil portion, and a bend-less flange portion located on the neck side of the main coil portion. The maximum coil thickness of the neck-side flange portion is greater than the maximum coil thickness of the main coil portion near the neck-side flange portion.

3 Claims, 6 Drawing Sheets

COLOR CATHODE RAY TUBE APPARATUS

CROSS-REFERENCE TO RELATED APPLICATIONS

This is a Continuation Application of PCT Application No. PCT/JP02/02468, filed Mar. 15, 2002, which was not published under PCT Article 21(2) in English.

This application is based upon and claims the benefit of priority from the prior Japanese Patent Application No. 2001-091095, filed Mar. 27, 2001, the entire contents of which are incorporated herein by reference.

BACKGROUND OF THE INVENTION

1. Field of the Invention

This invention relates to a color cathode ray tube apparatus used for a high-quality color television set or high-resolution display, and more particularly, to a color cathode ray tube apparatus improved in focusing properties that arose a problem related to flattening of a screen and reduction of the depth thereof.

2. Description of the Related Art

In general, a color cathode ray tube apparatus of an in-line self-convergence type comprises an in-line electron gun structure and a deflection yoke. The electron gun structure emits three electron beams, which are arranged in a line and include a center beam and a pair of side beams that pass on the same horizontal plane. The deflection yoke generates a non-uniform deflecting magnetic field that is formed of a horizontally deflecting magnetic field of the pincushion type and a vertically deflecting magnetic field of the barrel type.

However, the in-line self-convergence color cathode ray tube apparatus has the following two problems. The problems include (1) a problem that involves distortion of beam spots that causes lowering of the resolution at the horizontal axis end portions of the phosphor screen, in particular, and (2) a problem that the focusing properties worsen if a bendless coil is used as a horizontal deflecting coil in view of reduction in power consumption.

The first problem will be described first.

The angle of incidence of the three electron beams is a cause of this problem. The three electron beams that are directed toward the central portion of the phosphor screen land on the phosphor screen substantially at right angles thereto (angle of incidence ≈0°). Therefore, beam spots that are formed on the central portion of the phosphor screen are free from distortion. On the other hand, the angle of incidence of the three electron beams that land on the peripheral portion of the phosphor screen increases as the deflection angle increases. Therefore, beam spots that are formed on the peripheral portion of the phosphor screen are distorted into a shape that extends in the radial direction. This distortion is further promoted as the screen flattens or the deflection angle widens.

However, the electron beams that are directed to the vertical axis end portions of the phosphor screen are subjected to reciprocal influences, that is, the influence of the barrel-type vertically deflecting magnetic field and the influence of the angle of incidence upon the phosphor screen. Thus, the distortion of the beam spots is eased. On the other hand, the electron beams that are directed to the horizontal axis end portions of the phosphor screen are subjected to synergetic influences, that is, the influence of the pincushion-type horizontally deflecting magnetic field and the influence of the angle of incidence upon the phosphor screen. Thus, the distortion of the beam spots is promoted.

In the color cathode ray tube apparatus with the aforesaid construction, therefore, beam spots are distorted in the manner shown in FIG. 10. A special problem here is that the beam spots are distorted to be oblong at the end portions in the direction of a horizontal axis H that contains the directions of diagonal axes D of the phosphor screen. The importance of this problem has recently increased as the reduction of the depth of the color cathode ray tube apparatus and the flatness of the screen have started to be considered seriously. If a face panel is simply flattened, the angle of incidence of the electron beams at the H-axis end portions of the phosphor screen increases, so that the beam spots are distorted to be oblong.

In a color cathode ray tube apparatus of which the effective diagonal length of the phosphor screen is 46 cm, the deflection angle is 90°, the curvature radius of the outer surface of the face panel is 1,330 mm, and the curvature radius of the inner surface of the face panel is 1,240 mm, the aspect ratio of the beam spots at the H-axis end portions of the phosphor screen is 0.50 (vertical diameter/horizontal diameter). In a color cathode ray tube apparatus in which the inner and outer surfaces of the face panel are perfectly flattened (curvature radius is infinite), on the other hand, the aspect ratio of the beam spots at the H-axis end portions of the phosphor screen is lowered to 0.45.

The following is a description of the second problem.

In the color cathode ray tube apparatus, the deflection yoke is a substantial source of power consumption. In order to reduce this power consumption, it is essential to reduce power consumption by the horizontal deflecting coil of the deflection yoke, in particular. In order to solve this problem, a horizontal deflecting coil 75H having a bendless coil structure is used as shown in FIG. 11. This bendless coil structure, compared with a bend-up coil structure, can make the deflection efficiency of electron beams on the neck side higher and the power consumption lower.

It is believed that the outside diameter of the bendless horizontal deflecting coil 75H on the neck side should be lessened to minimize the inside diameter of a magnetic core in order to reduce the power consumption. To attain this, the thickness of a neck-side flange portion 79 is reduced so that the tube-axis-direction length of the flange portion 79 is 20 mm or more, that is, the tube-axis-direction width of the flange portion 79 is made generous.

The flange portion 79 has a sectional area Sf shown in FIG. 12A along line A–A' of FIG. 11, a sectional area Sm shown in FIG. 12B along line B–B', and a sectional shape shown in FIG. 12C along line C–C'. Naturally, moreover, a maximum coil thickness Tf-max of the neck-side flange portion 79 shown in FIG. 12C is the same as a maximum coil thickness Tm-max of a main coil portion 80 shown in FIG. 12B near the neck side thereof. Likewise, a sectional area Sf on a plane that contains a tube axis Z of the neck-side flange portion 79 and a vertical axis V is the same as a sectional area Sm on a plane perpendicular to a tube axis Z of the main coil portion 80, since the number of turns of the coil of the flange portion 79 is fixed.

FIG. 13 shows properties obtained as a result of analysis of pincushion-barrel magnetic field distributions on the respective tube axes of horizontally deflecting magnetic fields for the case where the horizontal deflecting coil 75H is formed of a bendless coil and the case where it is formed of a bend-up coil. In the diagram, continuous line a represents a property of the bendless coil, and broken line b represents a property of the bend-up coil. A pincushion-barrel magnetic field distribution on the tube axis of an ideal horizontally deflecting magnetic field is a property indicated by broken line b in the diagram, like that of the bend-up coil. Thus, a magnetic field distribution is preferred such that a barrel magnetic field c and a pincushion magnetic field d are formed on the neck side and the phosphor-screen side, respectively.

More specifically, the barrel magnetic field c on the neck side corrects a dislocation (HCR) between the center beam and the pair of side beams, having reached the horizontal axis end portions of the phosphor screen, in a positive direction (such that the center beam is situated nearer to the peripheral side of the phosphor screen than the center between the pair of side beams is). Further, the pincushion magnetic field d on the phosphor-screen side corrects a dislocation (XH) between the pair of side beams, having reached the horizontal axis end portions of the phosphor screen, in a negative direction (or under-convergence direction). Thus, the three electron beams on the phosphor screen can be converged.

In the neck-side portion of the bendless coil, however, coil elements 81 on the side of the horizontal axis H are formed so that their magnetic path length (length in the direction of the tube axis Z) has its maximum (Lm) on the neck side, as shown in FIG. 11. On the other hand, coil elements 82 on the side of the vertical axis V, that is, the coil elements 82 situated at the upper end portion of the bendless flange portion 79, have their magnetic path length (Lf) shorter than that of the coil elements 80 by a margin corresponding to the flange length (Ls). The coil elements 80 nearer to the horizontal axis H generate more intense pincushion magnetic fields as horizontally deflecting magnetic fields. Naturally, therefore, a pincushion-barrel magnetic field distribution a on the tube axis of the bendless coil shown in FIG. 13 becomes a pincushion magnetic field e near the neck-side end portion, so that the HCR is caused to act in the negative direction in this portion.

In the bendless coil of this type, therefore, a barrel magnetic field f must be intensified to adjust the HCR. However, the intensification of the barrel magnetic field f causes the XH to change in the positive direction. Thus, the XH on the phosphor screen must be adjusted by intensifying a pincushion magnetic field g, thereby increasing the force to cause the XH to act in the negative direction. In the diagram, portions h and i correspond to leakage magnetic fields that leak from the horizontal deflecting coil toward the neck on the back side and are normally of the barrel-type on the neck side of the bend-up coil and the bendless coil.

If the winding distribution of the bendless coil thus used is adjusted so as to correct both the XH and the HCR, the pincushion magnetic field g must be made more intense on the phosphor-screen of the deflection yoke than in the case of the bend-up coil. If the pincushion magnetic field g is intensified, therefore, the focusing properties inevitably worsen.

Although the focusing properties can be improved with use of the bend-up coil, in contrast with this, the power consumption of the deflection yoke inevitably increases. Recently, the power consumption of the deflection yoke has started to be lowered by making the respective sectional shapes of a yoke mounting portion, on which a deflection yoke of a funnel is mounted, a deflecting coil, and a magnetic core substantially rectangular. In consideration of variation in manufacture and the like, however, the magnetic core with the substantially rectangular section used in this case should preferably be of an undivided type. Naturally, therefore, the horizontal deflecting coil should be made up of the bendless coil.

Conventionally, in the case where the bendless coil is used to lower the power consumption in this manner, it is hard to ease the distortion of beam spots without failing to maintain satisfactory focusing properties, so that images of satisfactory display quality levels cannot be displayed.

BRIEF SUMMARY OF THE INVENTION

This invention has been contrived in order to solve these problems, and its object is to provide a color cathode ray tube apparatus capable of displaying images of satisfactory display quality levels without failing to reduce power consumption.

A color cathode ray tube apparatus according to a first aspect of this invention comprises a substantially rectangular face panel having a phosphor screen on the inner surface thereof; a funnel connected to the face panel; an electron gun structure configured to emit electron beams toward the phosphor screen; and a deflection yoke mounted on the outer surface of the funnel and configured to generate a deflecting magnetic field for deflecting the electron beams emitted from the electron gun structure, the deflection yoke including a horizontal deflecting coil for deflecting the electron beams in a horizontal direction, the horizontal deflecting coil having a main coil portion located along the direction of a tube axis, a flange portion located on the phosphor-screen side of the main coil portion, and a bendless flange portion located on the neck side of the main coil portion, the maximum coil thickness of the neck-side flange portion being greater than the maximum coil thickness of the main coil portion near the neck-side flange portion.

A color cathode ray tube apparatus according to a second aspect of this invention comprises a substantially rectangular face panel having a phosphor screen on the inner surface thereof; a funnel connected to the face panel; an electron gun structure configured to emit electron beams toward the phosphor screen; and a deflection yoke mounted on the outer surface of the funnel and configured to generate a deflecting magnetic field for deflecting the electron beams emitted from the electron gun structure, the deflection yoke including a horizontal deflecting coil for deflecting the electron beams in a horizontal direction, the horizontal deflecting coil having a main coil portion located along the direction of a tube axis, a flange portion located on the phosphor-screen side of the main coil portion, and a bendless flange portion located on the neck side of the main coil portion, the length of the neck-side flange portion in the tube-axis direction being smaller than 20 mm.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A color cathode ray tube apparatus according to an embodiment of this invention will now be described in detail with reference to the accompanying drawings.

Figure 1:
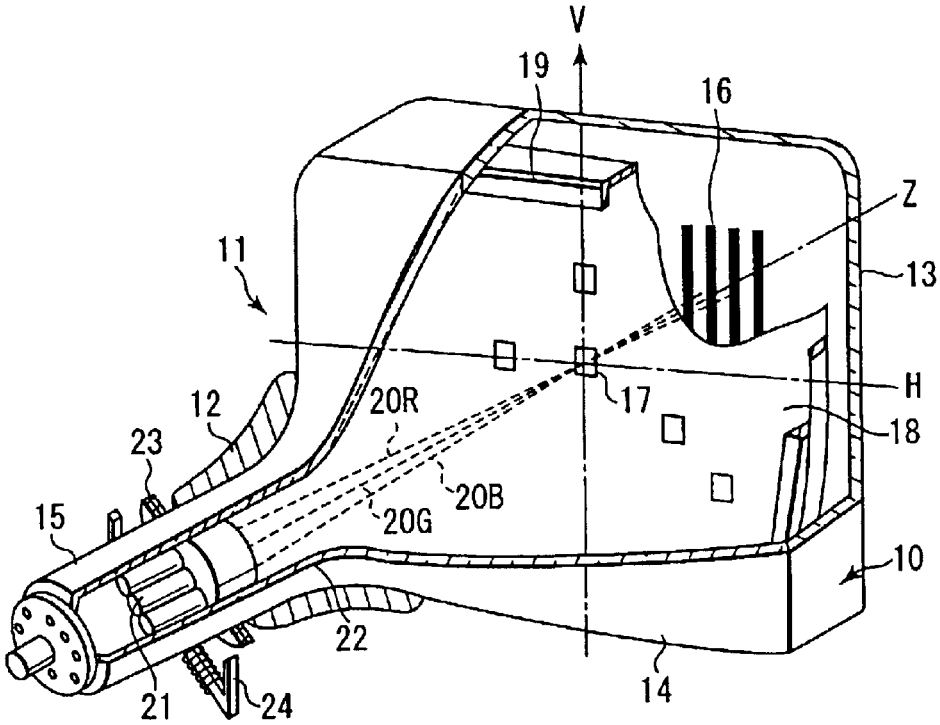
FIG. 1 is a cutaway perspective view schematically showing a construction of an in-line color cathode ray tube apparatus according to an embodiment of this invention.

As shown in FIG. 1, an in-line self-convergence color cathode ray tube apparatus comprises a color cathode ray tube 11 fitted with a deflection yoke 12. This color cathode ray tube 11 has a vacuum envelope 10 of glass. The vacuum envelope 10 is formed of a substantially rectangular face panel 13, a funnel 14 connected to the face panel 13, and a cylindrical neck 15 connected to a small-diameter portion end of the funnel 14. The outer surface of the face panel 13 is formed into a flat surface having a horizontal axis (H-axis) and a vertical axis (V-axis) that pass through a tube axis (Z-axis) and extend at right angles to each other. Provided on the inner surface of the face panel 13 is a phosphor screen 16 that has striped three-color phosphor layers that glow blue, green, and red, individually. A shadow mask 18 for color screening is located at a distance from and opposite to the phosphor screen 16 with the aid of a mask frame 19. The shadow mask 18 has a large number of electron beam holes that are formed at given arrangement pitches in its surface opposite the phosphor screen 16.

An in-line electron gun structure 21 is located in the neck 15. The electron gun structure 21 emits three electron beams 20B, 20G and 20R, which are arranged in a line and include a center beam 20C and a pair of side beams 20B and 20R that pass on the same horizontal plane.

The deflection yoke 12 is mounted on a deflection yoke mounting portion 22 that ranges form the funnel side of the neck 15 to the small-diameter portion of the funnel 14. The deflection yoke 12 generates a non-uniform deflecting magnetic field that deflects the three electron beams 20B, 20G and 20R emitted from the electron gun structure 21 in the horizontal and vertical directions. This non-uniform deflecting magnetic field is formed of a horizontally deflecting magnetic field of the pincushion type and a vertically deflecting magnetic field of the barrel type. A purity convergence magnet (PCM) 23 and a coma-free coil 24 are provided on the outer surface of the neck 15 behind the deflection yoke 12.

Figure 2:
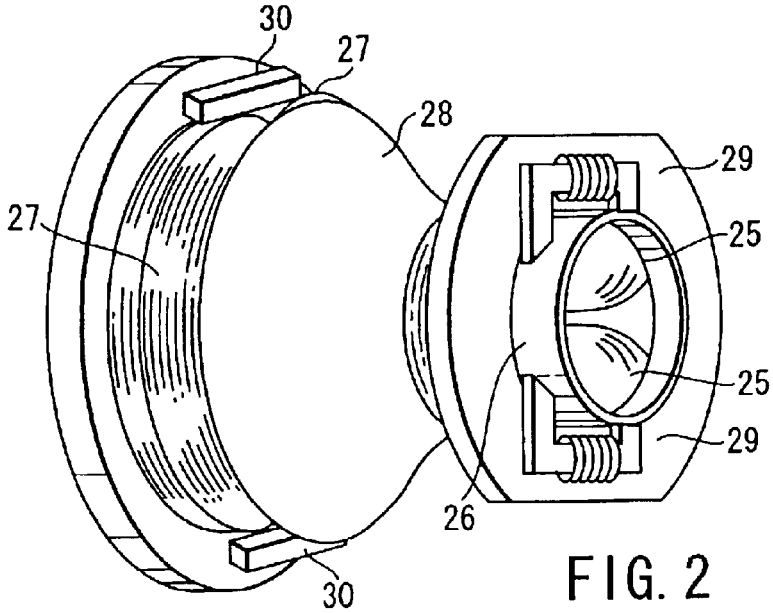
FIG. 2 is a perspective view schematically showing a construction of a deflection yoke applied to the color cathode ray tube apparatus shown in FIG. 1.

As shown in FIG. 2, the deflection yoke 12 is provided with a pair of bendless horizontal deflecting coils 25, top and bottom, and a pair of bendless vertical deflecting coils 27, left and right. The horizontal deflecting coils 25 and the vertical deflecting coils 27 are separated by means of a plastic separator 26. A funnel-shaped magnetic core 28 is located outside the horizontal deflecting coils 25 and the vertical deflecting coils 27. Further, the deflection yoke 12 is formed having a pair of coma-free coils 29, top and bottom, on the outside face of a small-diameter portion of the separator 26 on the side of the neck 15, a pair of NS magnets 30, top and bottom, on the outside face of a large-diameter portion of the separator 26 on the side of the phosphor screen 15, and the PCM 23 shown in FIG. 1.

The PCM 23 is composed of a pair of plate-like ring-shaped magnets, that is, a purity magnet and a static convergence magnet. In this PCM 23, magnetic forces for the three electron beams 20B, 20G and 20R are changed by rotating the two ring-shaped magnets, whereby the respective trajectories of the three electron beams 20B, 20G and 20R and the like are adjusted.

In the in-line self-convergence color cathode ray tube apparatus constructed in this manner, the three electron beams 20B, 20G and 20R are deflected by means of the non-uniform deflecting magnetic field that is generated by means of the deflection yoke 12, and are used to scan the phosphor screen 16 in a horizontal direction H and a vertical direction V. By adjusting the magnetic field distribution of the deflection yoke 12 and the PCM 23 as this is done, the three electron beams 20B, 20G and 20R can be converged on the whole phosphor screen 16 without requiring the use of any special dynamic correcting means.

Figure 7:
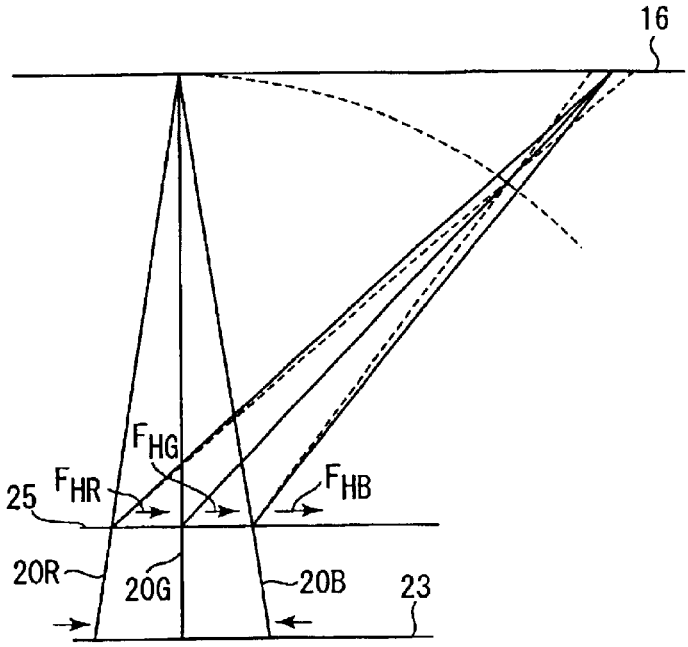
FIG. 7 is a diagram for illustrating the convergence of three electron beams in the central and peripheral portions of a phosphor screen.

Thus, the stroke length of the three electron beams 20B, 20G and 20R that reach the peripheral portion of the phosphor screen 16 is longer than the three electron beams 20B, 20G and 20R that reach the central portion of the phosphor screen 16, as shown in FIG. 7. If the PCM 23 is adjusted so that the three electron beams 20B, 20G and 20R are converged on the central portion of the phosphor screen, therefore, the pair of side beams 20B and 20R are over-converged in the manner indicated by broken lines in the drawing.

Figure 8:
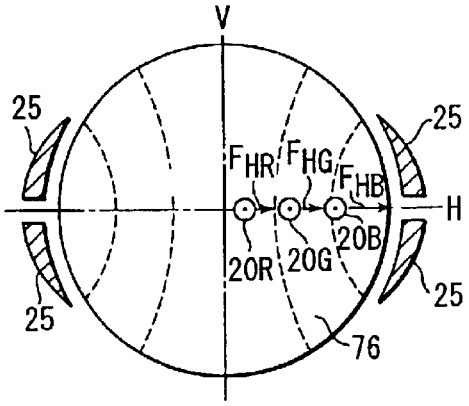
FIG. 8 is a diagram for illustrating a horizontally deflecting magnetic field.
Figure 9:
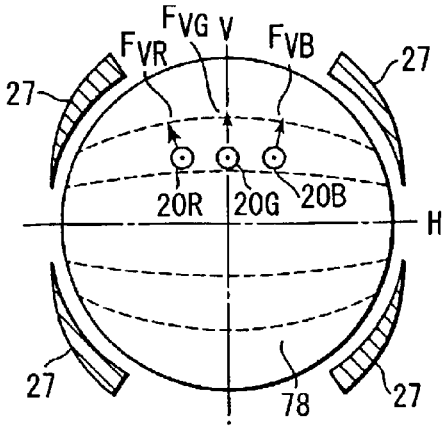
FIG. 9 is a diagram for illustrating a vertically deflecting magnetic field.
Figure 10:
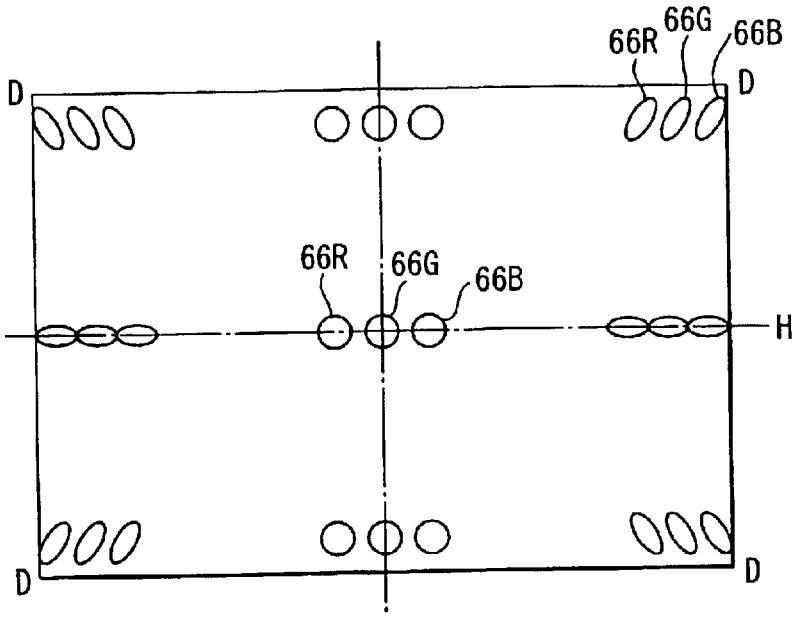
FIG. 10 (PRIOR ART)
FIG. 10 is a diagram for illustrating distortion of beam spots.
Figure 11:
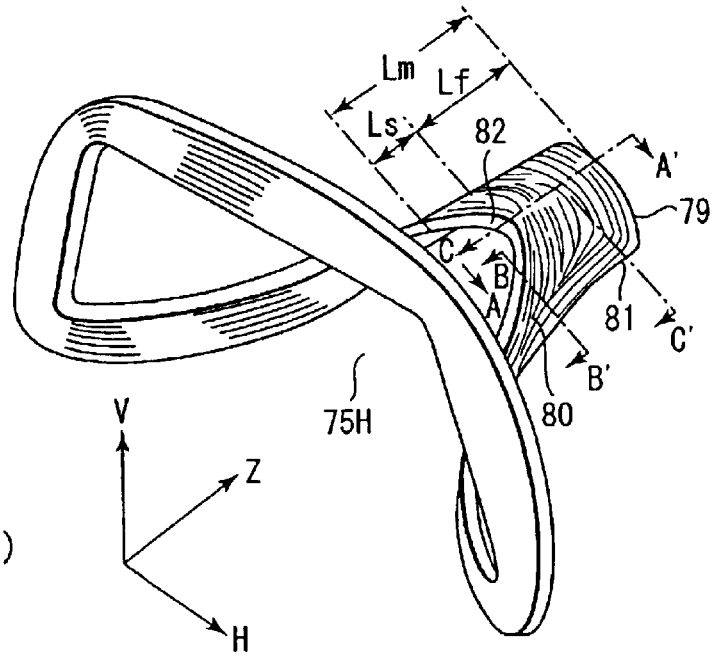
FIG. 11 (PRIOR ART)
FIG. 11 is a perspective view showing a bendless horizontal deflecting coil that constitutes a conventional deflection yoke applied to a color cathode ray tube apparatus.

To correct this, the horizontal deflecting coils 25 generate a pincushion-type horizontally deflecting magnetic field 76, as shown in FIG. 8. As this is done, forces FHB, FHG and FHR that the three electron beams 20B, 20G and 20R deflected to the right from the electron gun structure toward the phosphor screen 16 receive from the horizontally deflecting magnetic field 76 have relations FHB>FHG>FHR. Thus, the pair of side beams 20B and 20R are relatively displaced away from the center beam 20G (under-convergence). As shown in FIG. 9, moreover, the vertical deflecting coils 27 generate a barrel-type vertically deflecting magnetic field 78. The pair of side beams 66B and 66R receive forces FVB and FVR from the vertically deflecting magnetic field 78 in directions such that they recede from each other (under-convergence), as shown in FIG. 9.

By adjusting the respective intensities of the pincushion-type horizontally deflecting magnetic field 76 and the barrel-type vertically deflecting magnetic field 78, the three electron beams 20B, 20G and 20R are converged on the peripheral portion of the phosphor screen 16, as indicated by continuous lines in FIG. 7.

Thus, a color image is displayed on the phosphor screen 16.

Figure 3:
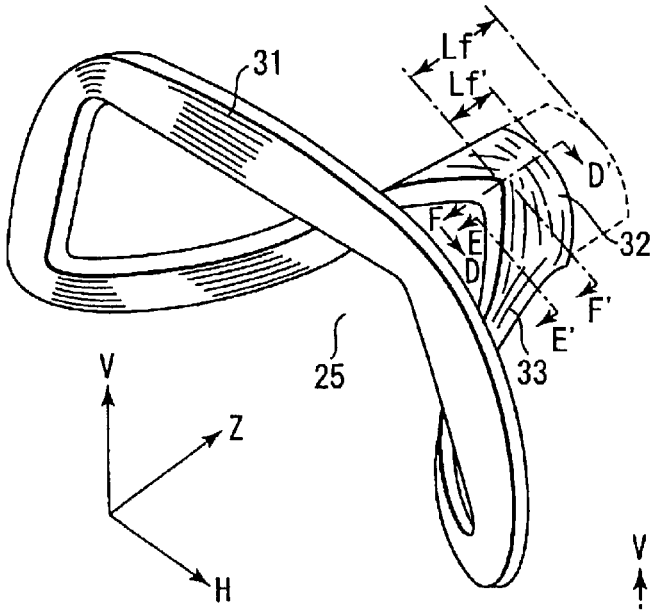
FIG. 3 is a perspective view schematically showing a construction of a bendless horizontal deflecting coil that constitutes the deflection yoke shown in FIG. 2.

As shown in FIG. 3, each bendless horizontal deflecting coil 25 that constitutes the deflection yoke 12 has a large-diameter flange portion 31 on the side of the funnel 14, a small-diameter flange portion 32 on the side of the neck 15, and a main coil portion 33. The flange portion 31 is molded having a bend-up shape. The flange portion 32 is molded having a bendless shape such that it extends in the direction of the tube axis Z and is compressed by pressing or other means in the tube-axis direction to a length smaller than a tube-axis-direction length Lf of a conventional flange portion indicated by broken line in the drawing.

Figure 4A:
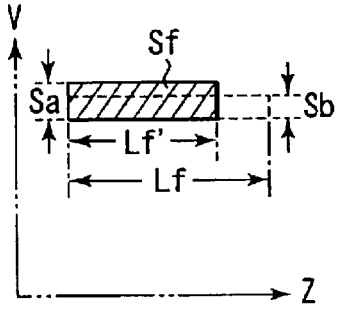
FIG. 4A is a view showing a winding state of a flange portion as taken along line D–D' of FIG. 3.
Figure 12A:
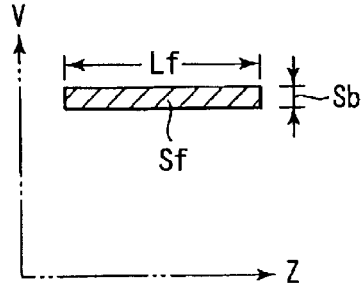
FIG. 12A (PRIOR ART)
FIG. 12A is a view showing a winding state of a flange portion as taken along line A–A' of FIG. 11.

Thus, a section of the flange portion 32 taken along line D–D' that extends along the tube axis Z has a length Lf' in the tube-axis direction and a thickness Sa in the vertical direction V perpendicular to the tube-axis direction, as shown in FIG. 4A. The tube-axis-direction length Lf' of the flange portion 32 is smaller than the length Lf of the conventional flange portion shown in FIG. 12A. Further, the vertical-direction thickness Sa of the flange portion 32 is greater than a thickness Sb of the conventional flange portion shown in FIG. 12A.

Figure 4B:
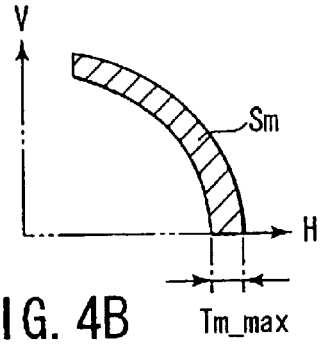
FIG. 4B is a view showing a winding state of the flange portion as taken along line E–E' of FIG. 3.
Figure 12B:
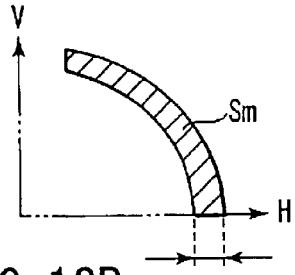
FIG. 12B (PRIOR ART)
FIG. 12B is a view showing a winding state of the flange portion as taken along line B–B' of FIG. 11.
Figure 12C:
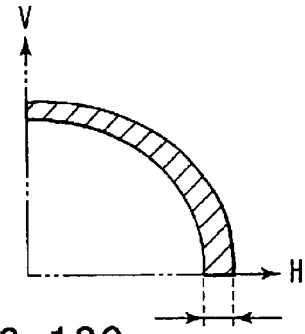
FIG. 12C (PRIOR ART)
FIG. 12C is a view showing a winding state of the flange portion as taken along line C–C' of FIG. 11.

Further, FIG. 4B shows a section of the flange portion 32 taken along line E–E' of FIG. 3. As shown in FIG. 4B, there is no substantial difference between a maximum coil thickness Tm-max of the main coil portion 33 near the neck side thereof and the conventional one shown in FIG. 12B.

Figure 4C:
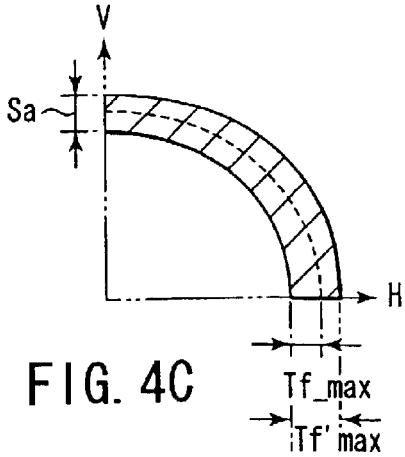
FIG. 4C is a view showing a winding state of the flange portion as taken along line F–F' of FIG. 3.

Furthermore, FIG. 4C shows a section of the flange portion 32 taken along line F–F' of FIG. 3. As shown in FIG. 4C, a maximum coil thickness Tf'-max of the flange portion 32 is greater than the conventional one indicated by broken lines, so that there is a relation Tf'-max>Tf-max. Naturally, the maximum coil thickness Tf'-max of the flange portion 32 shown in FIG. 4C is greater than the maximum coil thickness Tm-max of the main coil portion 33 shown in FIG. 4B near the neck-side flange portion thereof.

Figure 5:
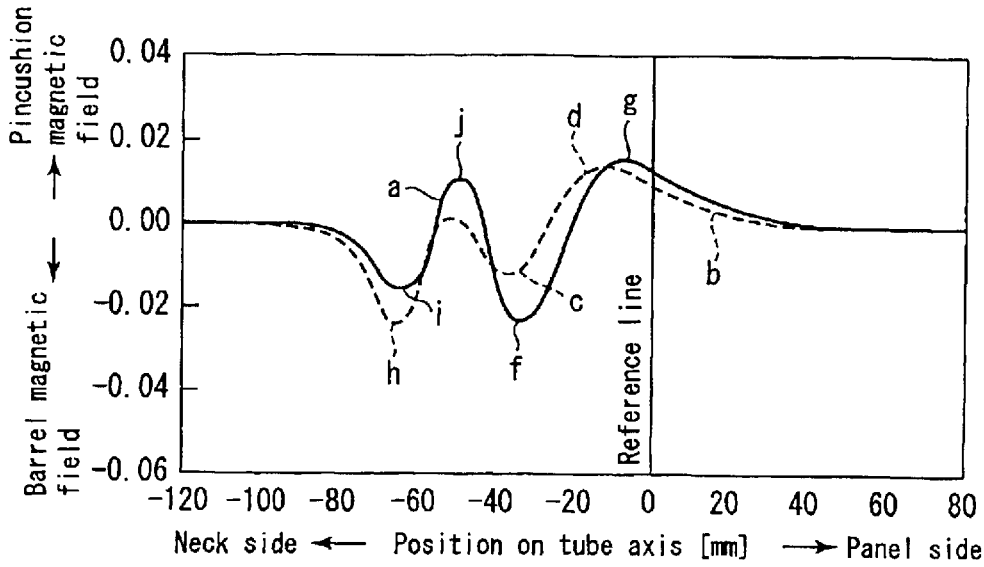
FIG. 5 is a diagram showing the magnetic field distribution of the horizontal deflecting coil shown in FIG. 3.

The bendless horizontal deflecting coils 25 constructed in this manner generate a horizontally deflecting magnetic field that has pincushion-barrel magnetic field distribution on the tube axis, such as the one shown in FIG. 5. In this diagram, continuous line a represents the magnetic field distribution of the horizontal deflecting coils 25, while broken line b represents the magnetic field distribution of a bend-up coil. Thus, the horizontal deflecting coils 25 form a magnetic field distribution a such that a barrel-type magnetic field f and a pincushion-type magnetic field g are formed on the neck side and the phosphor-screen side, respectively. Further, the horizontal deflecting coils 25 form a pincushion magnetic field j on the neck side.

As mentioned before, this pincushion magnetic field j causes the HCR to act in the negative direction. Preferably, therefore, the pincushion magnetic field j that is generated on the neck side should be made as small as possible. In the horizontal deflecting coils 25 with aforementioned configuration, the neck-side pincushion magnetic field j can be made smaller than the neck-side pincushion magnetic field e that is generated by means of the conventional bendless deflecting coil shown in FIG. 13.

Figure 13:
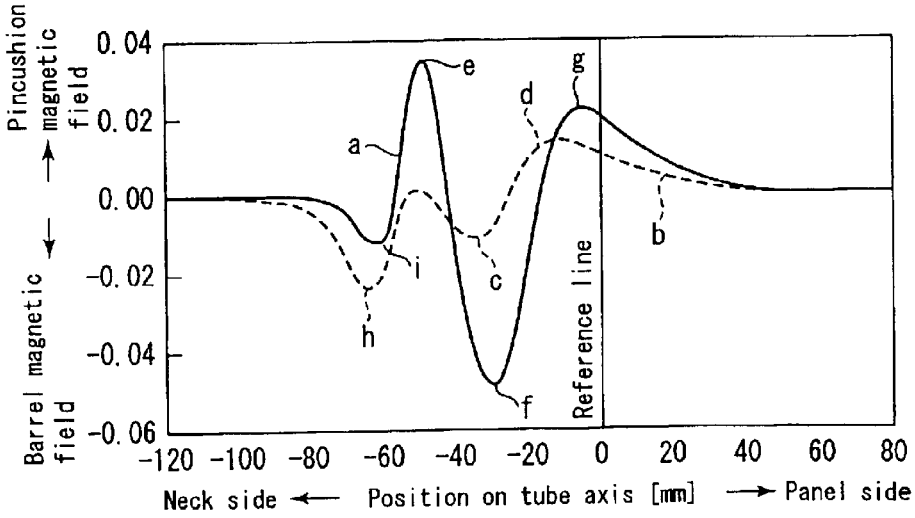
FIG. 13 is a diagram showing the magnetic field distribution of the horizontal deflecting coil shown in FIG. 11.

More specifically, in the case of the conventional bendless horizontal deflecting coil, as shown in FIG. 13, the pincushion magnetic field e on the neck side is larger than the pincushion magnetic field g on the panel side and is the largest. In the case of the horizontal deflecting coils 25 with the aforementioned configuration, on the other hand, the pincushion magnetic field g on face panel side is larger than the pincushion magnetic field j on the neck side and is the largest, as shown in FIG. 5.

Thus, the barrel magnetic field f need not be intensified to adjust the HCR, and the pincushion magnetic field g need not be intensified to cancel the intensification of the barrel magnetic field f. Thus, the pincushion magnetic field g that causes lowering of focusing properties can be diminished, whereby the focusing properties can be improved.

In each horizontal deflecting coil 25, as mentioned before, the length of the flange portion 32 in the tube-axis direction is reduced to increase its thickness. As the coil outside diameter of the flange portion 32 increases, therefore, the inside diameter of the magnetic core 28 on the side of the neck 15 must be increased correspondingly.

It is believed, in general, that the smaller the inside diameter of the magnetic core 28 on the side of the neck 15, the less the power consumption is. According to detailed examinations based on simulations and experimentals, however, it was found that the power consumption of the horizontal deflecting coils 25 before enlargement, if any, of the coil diameter and core diameter on the side of the neck 15 can be maintained without substantially changing the respective trajectories of the electron beams 20B, 20G and 20R that are directed toward the peripheral portion of the phosphor screen 16. This can be realized by extending the magnetic path length of the main coil portion 33 or the magnetic core 28 in the tube-axis direction toward the neck 15.

Thus, it was found that the focusing properties can be improved without changing the same power consumption of the conventional bendless coil if the tube-axis-direction length of the flange portion 32 of the bendless coil on the side of the neck 15 is reduced.

Accordingly, reduction of the tube-axis-direction length of the flange portion 32 of each bendless horizontal deflecting coil 25 on the side of the neck 15 was examined. Based on the result of this examination, the horizontal deflecting coil 25 is constructed for a relation Tf'>Tm such that a coil thickness Tf' of the flange portion 32 is totally greater than a coil thickness Tm of the main coil portion 33 near the side of the neck 15, as shown in FIG. 4C. In this horizontal deflecting coil 25, the tube-axis-direction length Lf' of the flange portion 32 is smaller than 20 mm (tube-axis-direction length Lf of the conventional flange portion: 20 mm), as shown in FIG. 4A. In this embodiment, Lf' is reduced to 12 mm.

FIG. 5 shows the magnetic field distribution of the horizontal deflecting coil 25 for this case. More specifically, the pincushion magnetic field j generated in the flange portion 32 could be made less intense than the conventional pincushion magnetic field e and the pincushion magnetic field g that is generated on the side of the phosphor screen 16.

Thus, even when the face panel 13 was flattened, the aspect ratio of beam spots could be improved to about 0.50 (vertical diameter/horizontal diameter) that had been allowed before flattening.

Conventionally, the beam spots used to worsen when a 90° deflecting tube was changed over to a 100° deflecting tube. On the other hand, a beam spot shape equivalent to that of the 90° deflecting tube used before flattening can be formed even with the use of a 100° deflecting tube whose depth is shorter than that of the 90° deflecting tube if the horizontal deflecting coils 25 according to this embodiment are used and if the tube-axis-direction length of the flange portion 32 is set to about 7 mm, which is smaller than the conventional value. If the horizontal deflecting coils 25 according to this embodiment are applied to the 90° deflecting tube, moreover, more satisfactory beam spots can be obtained.

Figure 6:
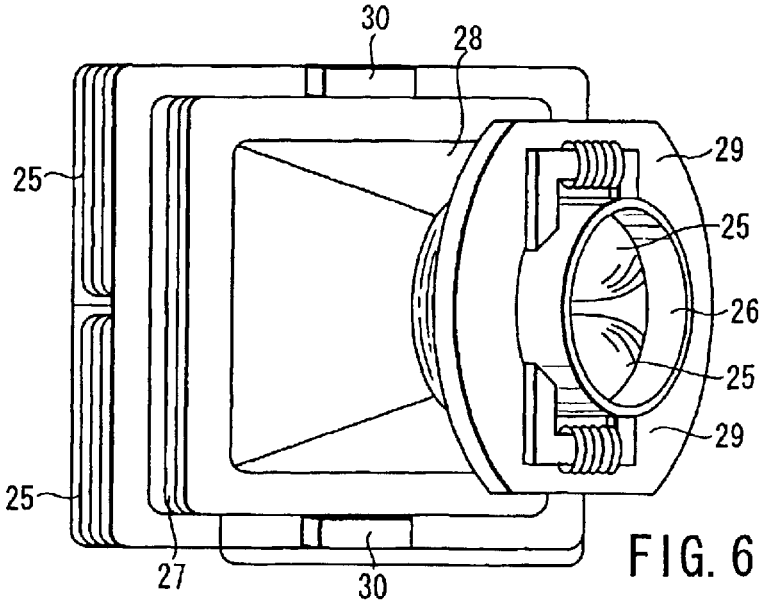
FIG. 6 is a perspective view schematically showing another construction of the deflection yoke applicable to the in-line color cathode ray tube apparatus shown in FIG. 1.

It is to be understood that this invention is not limited to the color cathode ray tube apparatus with the configuration described above, and that various applications and modifications may be effected therein. For example, a deflection yoke 12, such as the one shown in FIG. 6, can be also applied to a color cathode ray tube 11 in which a deflection yoke mounting portion 22 of a funnel 14 is angular. More specifically, this deflection yoke 12 combines a magnetic core 28, horizontal deflecting coils 25, and a vertical deflecting coil 27 in a square configuration. In a cathode ray tube apparatus that combines the cathode ray tube 11 and the deflection yoke 12 constructed in this manner, power consumption can be reduced further.

Moreover, the tube-axis-direction length of the flange portion 32 may be reduced by compressing the flange portion 32 on the side of the neck 15 in the tube-axis direction by pressing or the like, thereby compressing gap portions between coils that constitute the flange portion 32 or covering portions of the coils. In other words, a sectional area Sf of the flange portion 32 on a plane that contains the tube axis and the vertical axis may be made smaller than a sectional area Sm of the main coil portion 33 on a plane perpendicular to the tube axis, as shown in FIGS. 4A and 4B. Thus, the tube-axis-direction length of the flange portion 32 can be reduced without extremely increasing its thickness (substantially equal to the thickness of the conventional flange portion), so that the inside diameter of the magnetic core 28 need not be increased. Consequently, the magnetic core 28 and the deflection yoke 12 can be downsized.

Further, the vertical deflecting coil 27 may be formed as a toroidal coil having coils wound on the magnetic core 28 or a bend-up type.

According to this cathode ray tube apparatus, as described above, the horizontal deflecting coil is formed of a bendless coil in order to reduce the power consumption. The maximum coil thickness of the neck-side flange portion of the horizontal deflecting coil is greater than the maximum coil thickness near the neck-side flange portion of the main coil portion. Further, the neck-side flange portion of the horizontal deflecting coil is shortened in the tube-axis direction. Thus, beam spots of a satisfactory shape can be formed at the horizontal-axis end portions of the phosphor screen. Further, the electron beam focusing performance can be improved. Furthermore, excellent convergence properties can be obtained. Thus, images of satisfactory display quality levels can be displayed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube apparatus comprising:

a substantially rectangular face panel having a phosphor screen on the inner surface thereof;

a funnel connected to the face panel;

an electron gun structure configured to emit electron beams toward the phosphor screen; and a deflection yoke mounted on the outer surface of the funnel and configured to generate a deflecting magnetic field for deflecting the electron beams emitted from the electron gun structure, the deflection yoke including a horizontal deflecting coil for deflecting the electron beams in a horizontal direction, the horizontal deflecting coil having a main coil portion located along the direction of a tube axis, a flange portion located on the phosphor-screen side of the main coil portion, and a bendless flange portion located on the neck side of the main coil portion, the maximum coil thickness of the neck-side flange portion being greater than the maximum coil thickness of the main coil portion near the neck-side flange portion.

2. A cathode ray tube apparatus according to claim 1, wherein the sectional area of said neck-side flange portion on a plane containing the tube axis and a vertical axis is smaller than the sectional area of the main coil portion on a plane perpendicular to the tube axis.

3. A cathode ray tube apparatus comprising:

a substantially rectangular face panel having a phosphor screen on the inner surface thereof;

a funnel connected to the face panel;

an electron gun structure configured to emit electron beams toward the phosphor screen; and a deflection yoke mounted on the outer surface of the funnel and configured to generate a deflecting magnetic field for deflecting the electron beams emitted from the electron gun structure, the deflection yoke including a horizontal deflecting coil for deflecting the electron beams in a horizontal direction, the horizontal deflecting coil having a main coil portion located along the direction of a tube axis, a flange portion located on the phosphor-screen side of the main coil portion, and a bendless flange portion located on the neck side of the main coil portion, the length of the neck-side flange portion in the tube-axis direction being smaller than 20 mm.

* * * * *